United States Patent [19]

Busse et al.

[11] Patent Number: 4,983,126

[45] Date of Patent: Jan. 8, 1991

[54] APPARATUS FOR ELECTRICAL CONNECTION OF INSERTABLE ELECTRICAL ASSEMBLIES

[75] Inventors: Ingeborg Busse; Eduard Mair, both of Munich, Fed. Rep. of Germany

[73] Assignee: Siemens Aktiengesellschaft, Berlin and Munich, Fed. Rep. of Germany

[21] Appl. No.: 527,424

[22] Filed: May 23, 1990

[30] Foreign Application Priority Data

Jun. 17, 1989 [DE] Fed. Rep. of Germany ..... 3919586

[51] Int. Cl.[5] ..... H01R 9/09

[52] U.S. Cl. ..... 439/61; 439/66

[58] Field of Search ..... 439/61, 66, 65, 74; 361/413, 415

[56] References Cited

U.S. PATENT DOCUMENTS

| | | | |
|---|---|---|---|
| 4,133,592 | 1/1979 | Cobaugh et al. | 439/74 |
| 4,164,362 | 8/1979 | Cobaugh et al. | 439/64 |
| 4,223,968 | 9/1980 | Kawabata et al. | 439/61 |
| 4,401,358 | 8/1983 | Daigaku | 439/61 |
| 4,738,625 | 4/1988 | Burton et al. | 439/66 X |

FOREIGN PATENT DOCUMENTS

| | | |
|---|---|---|
| 2651216 | 5/1977 | Fed. Rep. of Germany . |
| 7929088 | 1/1980 | Fed. Rep. of Germany . |
| 3516739 | 11/1986 | Fed. Rep. of Germany . |
| 2845884 | 3/1987 | Fed. Rep. of Germany . |
| 3604860 | 8/1987 | Fed. Rep. of Germany . |

*Primary Examiner*—Neil Abrams
*Assistant Examiner*—Khiem Nguyen
*Attorney, Agent, or Firm*—Hill, Van Santen, Steadman & Simpson

[57] ABSTRACT

Spring contacts are arranged in the insertion direction between immediate-neighboring printed circuit boards of various assemblies, the contact locations in the spring contacts being at the distance of a parting line of the assemblies. The spring contacts are directly electrically connected to the printed circuit boards, more specifically to circuit interconnects thereof. As a result of this structure, a direct electrical connection between the printed circuit boards can be produced while avoiding plug-type connectors for the assemblies. The assemblies can nonetheless be individually inserted unimpeded in an arbitrary sequence.

15 Claims, 1 Drawing Sheet

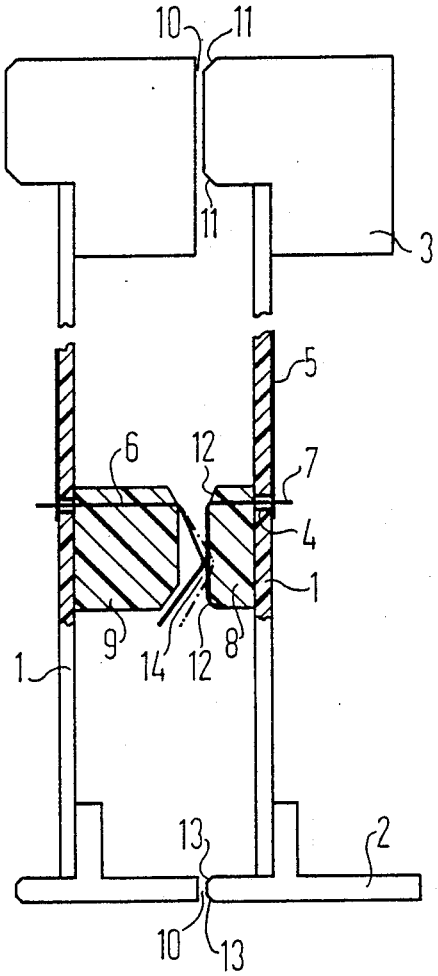
10
11
11
3
5
6
12
7
4
1
9
14
12
8
1
13
2
10
13

APPARATUS FOR ELECTRICAL CONNECTION OF INSERTABLE ELECTRICAL ASSEMBLIES

BACKGROUND OF THE INVENTION

1. Field of the Invention

The present invention relates to apparatus for electrical connection of electrical assemblies insertable into a magazine.

2. Description of the Prior Art

It is well known in the art to connect the various assemblies of a magazine to one another via back plane plugs and via back plane wiring.

It is also well-known to provide plug connectors at the front covers of printed circuit boards, plug cables that lead to other assemblies capable of being plugged into these plug connectors.

There is a trend to higher and higher operating frequencies as well as to more and more complex function units in many areas of electronic data traffic, for example in switching systems. This requires more and more and shorter and shorter connecting paths. The signal running times must be kept as short as possible.

To this end, U.S. Pat. No. 4,133,592, fully incorporated herein by this reference, for example, also discloses that plug connectors perpendicularly pluggable onto printed circuit boards be provided on the printed circuit boards, so that neighboring assemblies can be directly connected to one another. This, however, must occur outside of the module frame. The assemblies connected to one another in such a fashion can only be inserted together. This limit the number of assemblies to be joined to one another.

The German patent application No. 35 16 739 A1 also discloses a contact bridge between neighboring printed circuit boards, this being formed by a blade contact at one printed circuit board and by a fork-shaped spring contact at the other printed circuit board. The contact bridge is constructed such that the sliding direction during contacting coincides with the insertion direction of the assemblies.

SUMMARY OF THE INVENTION

The object of the present invention therefore, is to provide a direct connection between the printed circuit boards of neighboring assemblies that can be manufactured in a cost-effective manner and in which the assemblies can be individually inserted unimpeded.

The above object is achieved, according to the present invention, in an apparatus for the electrical connection of electrical assemblies insertable into a magazine, wherein a direct electrical connection can be produced between printed circuit boards of neighboring assemblies on the basis of separable spring contacts and in which one contact is electrically connected to one of the printed circuit boards and a cooperating contact is respectively electrically connected to the neighboring printed circuit board, whereby the sliding direction during contacting coincides with the insertion direction of the assembly, and is particularly characterized i:: that a spring contact is deflectable perpendicular to the plane of the printed circuit board, and in that the contact location is arranged at a distance of a parting line between a front cover of an assembly and a plug-type connector mounted at the rear of the printed circuit board of the assembly.

Since the contacting direction of the contact parts now lies in the insertion direction, the electrical connection is only closed in the inserted condition. Due to the arrangement of the contact location in the region of the parting line between the assemblies, the contact parts can be conducted past the front cover of the neighboring assembly unimpeded during pulling or plugging. The assemblies are individually pluggable in this manner. An arbitrary number of assemblies can be connected to one another in an interrupted sequence.

According to a feature of the invention, the apparatus is particularly characterized in that the contact parts are fashioned as strip-shaped sheet metal parts that are bent off in essentially the insertion direction in the region of the contact location. This feature of the invention enables a cost-effective manufacture of the contact parts in the fashion of spring contacts.

According to another feature of the invention, the apparatus is particularly characterized in that one of the contact parts is resiliently constructed and the other contact part is non-resiliently constructed. This feature yields a defined position of the contact location with reference to the height over the printed circuit board. In order to enlarge the resilient region, it is also conceivable to fashion both contact parts to be freely resilient.

According to another feature of the invention, the apparatus is characterized in that the contact parts are bent U-shaped and have both ends secured in the printed circuit board. This feature enables a stable holding of the contact parts in the printed circuit boards.

According to another feature of the invention, the apparatus is particularly characterized in that the contact parts are held in mounting basis that can be put in place onto the printed circuit boards, and in that those ends of the contact parts facing towards the printed circuit board engage into bores of the printed circuit board. With this feature of the invention, the contact parts can have only one end introduced into the printed circuit board, so that space for additional interconnects is kept free thereon. The contact parts are accurately fixed in a stable position relative to the printed circuit boards due to the utilization of the mounting bases.

According to another feature of the invention, the non-resilient contact part presses against the mounting base parallel to the insertion direction in the region of the contact location. Therefore, the non-resilient contact part is fully supported by the mounting base and is precisely fixed in its position.

According to another feature of the invention, the apparatus is particularly characterized in that the mounting base for the non-resilient contact part comprises leading bevels on its edges for the resilient contact part. With this feature of the invention, it is achieved that the contact part fashioned as a leaf spring can be cost-effectively manufactured and be lent beneficial properties with respect to the spring power and spring path. A small-area contact location having a beneficial contact resistance arises due to the convex bending. At the same time, the contact part is also provided with leading bevels. What the bending of the resilient contact part toward the front cover achieves is that, when the assembly having the stationary contact part is inserted, this first strikes the freely-projecting end of the resilient contact part, whereby the resilient contact part can be deflected with lower force since the lever length is greater. When, however, the assembly having the fixed contact part is inserted first, the arising frictional force supports the excursion motion.

According to other features of the invention, the apparatus is particularly characterized in that the mounting base for the non-resilient contact part comprises leading bevels for the resilient contact part, and in that the front cover and/or a back-side plug-type connector of the assembly comprise leading bevels for engaging the resilient contact part.

According to another feature of the invention, the apparatus is particularly characterized in that the block-like mounting base for the resilient contact part comprises a bevel in the region of the free end thereof so that the spring region of the resilient contact part can be enlarged.

According to another feature of the invention, the apparatus is particularly characterized in that a plurality of contact parts are combined in one mounting base. With this feature, the manufacture and assembly expense for the contact parts with the mounting bases is reduced.

According to another feature of the invention, the apparatus is particularly characterized in that the spring contacts are arranged arbitrarily distributed on the printed circuit board. This feature makes it possible to arrange the spring contacts at the locations where the most beneficial conditions are established in view of the transmission length and the printed circuit board resolution.

According to another feature of the invention, the apparatus is particularly characterized in that the spring contacts are arranged at the same location on various type of printed circuit boards, and in that the bores for the resilient and non-resilient contact parts are offset from one another. This feature of the invention enables a cost-effective assembly of the spring contacts since the contact-equipping tools and receptacles can be optimally set up for these fixed positions.

According to another feature of the invention, the apparatus is characterized in that the spring contacts are arranged in the proximity of the front covers.

According to this feature, the contacts are arranged in a region of the printed circuit board having a lower interconnect density, whereby unalternating positions in different types of printed circuit boards can be realized in a particularly beneficial manner.

According to other features of the invention, the apparatus is characterized in that the front covers and the mounting bases for the contact parts are combined in a common member, and in that the plug-type connector is provided with receptacles for the contact parts. In accordance with these features, the manufacture and assembly costs can be further reduced and the features are particularly suitable for assemblies wherein constant positions are provided for the contacts.

BRIEF DESCRIPTION OF THE DRAWING

Other objects, features and advantages of the invention, its organization, construction and operation will be best understood from the following detailed description, taken in conjunction with the accompanying drawing on which there is a single FIGURE showing, in a side view, a pair of printed circuit boards in a relationship as they assume when mounted in a rack with the circuits of the boards electrically connected in accordance with the present invention.

DESCRIPTION OF THE PREFERRED EMBODIMENTS

Referring to the drawing, in a plan and a partial sectional view, two electrical assemblies are inserted into a magazine (not shown), each of the electrical assemblies respectively comprising a printed circuit board 1, a front cover 2 attached thereto, and a plug-type connector 3 attached to the rear side thereof. The printed circuit board 1 also comprises plated-through holes 4 that are connected to interconnects 5 of the printed circuit board. Contacts 6, 7 are pressed into the bores 4 and are electrically connected to the interconnects 5. The contacts 6 and 7 are accepted into mounting bases 8, 9 that are composed of insulating material. The ends of the contact parts 6, 7 are bent in the direction of the front covers 2. A stationary contact part 7 has its bent-off end extending on a straight line parallel to the printed circuit board 1 in the direction of the front cover 2 and lies against the appertaining mounting base 8 over its entire length. A resilient contact 6 projects beyond the mounting base 9 and has a free end resiliently deflectable perpendicular to the printed circuit board 1. Its 0 position is indicated by a dot-dash line.

The resilient contact 6 has its bent-off end bent convexly towards the fixed contact 7 and has its highest location pressing thereagainst. Together with the contact 7, it forms a spring contact connection 14 by which a direct electrical connection between two assemblies is produced. The contact location is thereby situated at the level of a parting line 10 between the neighboring front covers 2 or, respectively, plug-type connectors 3. This enables an unimpeded plugging and pulling of the individual assemblies in an arbitrary sequence without the possibility of a collision of the contact parts 6 or 7 with the components of the neighboring assembly.

It is possible to allow the resilient end of a contact 6, fashioned as a roof-like element, to project beyond the parting line 10. In this case, the contact is resilient deflected when it encounters the front cover 2 or the plug-type connector 3 without thereby suffering damage. In order to reduce the frictional wear, the front covers 2, the back plane plugs 3 and the mounting bases 8 for the stationary contacts 7 are provided with leading bevels 11, 12, 13.

The contacts 6, 7 are arranged in the proximity of the front covers 2. However, they can also be arranged arbitrarily distributed over the printed circuit board 1. Constantly unaltered or arbitrarily-changing positions can be provided for various types of printed circuit boards. It is also possible to combine the mounting bases 8, 9 with the front covers 2 or the plug-type connectors 3 to form a common component part. This is particularly suitable for cases in which the positions of the contacts 6, 7 always remain the same.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Connection apparatus for electrically connecting printed circuit boards which are insertable in a predetermined direction into a magazine, comprising:

first and second neighboring printed circuit boards each including edges, a first surface facing the like first surface of the other printed circuit board and an opposite, second surface;

circuit interconnects carried on said second surfaces;

a pair of front covers each mounted on a first edge of a respective printed circuit board;

a pair of electrical connectors each mounted on a second edge of respective printed circuit board opposite the respective front cover;

a first contact carried by said first printed circuit board electrically connected to a respective circuit interconnect thereof and including a first contact portion facing said second printed circuit board and at a predetermined distance from said first surface of said first printed circuit board; and a second contact carried by said second printed circuit board electrically connected to a respective circuit interconnect thereon and including a contact portion facing said first printed circuit board for engagement with said first contact portion.

2. The connection apparatus of claim 1, wherein:

said first and second printed circuit boards each include a plated-through hole in the area of the respective contact; and said first and second contacts each include a portion extending through a respective plated-through hole and connected to a respective circuit interconnect.

3. The connection apparatus of claim 1, wherein:

each of said contacts comprises a sheet metal strip bent essentially in the predetermined direction of insertion in the area of engagement.

4. The connection apparatus of claim 1, wherein:

said second contact is a resilient contact for resilient wiping engagement with said first contact.

5. The connection apparatus of claim 1, wherein:

said contacts are U-shaped elements each including two ends secured in the respective printed circuit board.

6. The connection apparatus of claim 1, and further comprising:

first and second bases each mounted on a respective printed circuit board; and each of said contacts includes a portion fixed in the respective base.

7. Connection apparatus for electrically connecting printed circuit boards which are insertable in a predetermined direction into a magazine, comprising:

first and second neighboring printed circuit boards each including edges, a first surface facing the like first surface of the other printed circuit board and an opposite, second surface;

circuit interconnects carried on said second surfaces;

first and second bases each mounted on a respective first surface;

plated-through holes extending through said first and second printed circuit boards in the areas adjacent said interconnects;

a non-resilient contact carried by said first printed circuit-board and including a connection portion fixed in said first base, extending through the respective plated-through hole and electrically connected to a respective circuit interconnect, and a contact portion pressing against said first base and extending in said predetermined direction of insertion at a predetermined distance from said first surface of said first printed circuit board;

a resilient contact including a connection portion extending through and fixed in said second base, extending through another of said plated-through holes and electrically connected to a respective circuit interconnect, and including a spring contact portion bent at an angle to said predetermined direction of insertion for resilient, yielding and wiping contact with said contact portion of said non-resilient contact, said spring contact portion comprising a convex shape; and said second base comprising a bevel in the region of the free end of said spring contact portion to avoid constricting the movement thereof.

8. The connection apparatus of claim 7, and further comprising:

a pair of front covers each connected to and carried on a corresponding edge of said first and second neighboring printed circuit boards, one of said covers including a pair of beveled edges with respect to said predetermined direction and the direction opposite thereto; and said spring contact portion convex shaped comprising a pair of integrally-connected sections each disposed at an angle with respect to the predetermined direction of insertion and the direction opposite thereto for yieldable bypass engagement with said beveled edges upon insertion and withdrawal of said second printed circuit board.

9. The connection apparatus of claim 7, and further comprising:

first and second electrical connectors each mounted at a respective edge of a respective first and second printed circuit board, each of said electrical connectors including a beveled leading edge and a beveled trailing edge with respect to said predetermined direction of insertion; and said convex-shaped spring contact portion including a pair of integrally-connected portions extending at a respective angle with respect to said predetermined direction of insertion for yieldable engagement with said trailing edge upon withdrawal of said first printed circuit board and with said leading edge upon insertion of said first printed circuit board.

10. The connection apparatus of claim 7, wherein:

said second base comprises a beveled edge opposite said predetermined direction of insertion for free non-interference movement of said spring contact portion upon deflection thereof by said non-resilient contact.

11. The apparatus of claim 7, and further comprising a plurality of said non-resilient contacts fixed in said first base; and a plurality of said resilient contacts fixed in said second base, each of said plurality of non-resilient and resilient contacts connected to respective circuit interconnects carried on the respective printed circuit boards.

12. The connection apparatus of claim 7, and further comprising:

a plurality of said spring contacts fixed in said second base and arranged arbitrarily distributed therein, each of said plurality of spring contacts connected to a respective circuit interconnect carried on said second printed circuit board.

13. The connection apparatus of claim 7, wherein:

said resilient contact is arranged at the same location on different types of printed circuit board; and said plated-through holes for said resilient contacts and said non-resilient contacts are offset from one another.

14. The connection apparatus of claim 7, and further comprising:

first and second front covers carried on respective edges of said first and second neighboring printed circuit boards; and said resilient contacts fixed in said second base are located in the proximity of said second front cover.

15. The connection apparatus of claim 14, wherein:

said front covers and said mounting bases are combined as a common member for the respective printed circuit boards.

* * * * *